United States Patent [19]

Rawlings et al.

[11] Patent Number: 4,976,639

[45] Date of Patent: Dec. 11, 1990

[54] POWER STEERING MECHANISM FOR MARINE INSTALLATIONS

[75] Inventors: David E. Rawlings, Palatine; Donald K. Sullivan, Prospect Heights, both of Ill.

[73] Assignee: Outboard Marine Corporation, Waukegan, Ill.

[21] Appl. No.: 225,260

[22] Filed: Jul. 28, 1988

[51] Int. Cl.[5] ..... B63H 21/26

[52] U.S. Cl. ..... 440/59; 440/61

[58] Field of Search ..... 440/49, 53, 61, 900; 114/144 R, 150; 74/480 B

[56] References Cited

U.S. PATENT DOCUMENTS

| | | | |
|---|---|---|---|
| 2,618,235 | 11/1952 | Clark, Jr. | 115/35 |
| 2,855,755 | 10/1958 | Auger | 60/54.5 |
| 2,928,377 | 3/1960 | Ford | 121/41 |
| 2,929,362 | 3/1960 | Hayner | 121/41 |
| 2,939,417 | 6/1950 | Hammock, Sr. | 114/150 |
| 3,045,650 | 7/1962 | Ambrosini | 121/38 |
| 3,358,564 | 12/1967 | Peterson | 91/375 |
| 3,373,642 | 3/1968 | Simpson | 83/76 |
| 3,450,087 | 6/1969 | Kuether | 114/150 |
| 3,605,809 | 9/1971 | Thorson | 137/624.27 |
| 3,613,504 | 10/1971 | Krauss | 91/32 |
| 3,631,833 | 1/1972 | Shimanckas | 115/18 |
| 3,692,260 | 8/1972 | Glaze et al. | 244/78 |
| 3,700,080 | 10/1972 | Delorean | 192/4 |
| 3,768,376 | 10/1973 | Orme | 94/466 |
| 3,980,001 | 9/1976 | Cyphelly | 91/420 |
| 3,986,578 | 10/1976 | Chanal | 180/158 |
| 4,041,889 | 8/1977 | Blanchard | 115/82 |
| 4,054,102 | 10/1977 | Borst et al. | 114/144 |
| 4,191,202 | 5/1980 | Brent | 137/112 |
| 4,199,005 | 4/1980 | Budzich | 137/596.13 |
| 4,216,797 | 8/1980 | Budzich | 137/596.13 |
| 4,227,481 | 10/1980 | Cox et al. | 440/61 |
| 4,295,833 | 10/1981 | Borst | 440/63 |
| 4,373,920 | 2/1983 | Hau et al. | 440/61 |
| 4,399,734 | 8/1983 | Kobelt | 91/1 |
| 4,419,084 | 12/1983 | Borst | 440/58 |
| 4,424,672 | 1/1984 | Kalhorn | 60/385 |
| 4,568,292 | 2/1986 | Hall | 440/61 |
| 4,578,039 | 3/1986 | Hall | 440/61 |
| 4,592,732 | 6/1986 | Ferguson | 440/61 |
| 4,595,370 | 6/1986 | Small | 440/61 |
| 4,615,290 | 10/1986 | Hall et al. | 114/150 |
| 4,632,049 | 10/1986 | Hall | 114/150 |
| 4,710,141 | 12/1987 | Ferguson | 440/61 |

FOREIGN PATENT DOCUMENTS

| | | |
|---|---|---|
| 59-120600 | 7/1984 | Japan . |
| 1394929 | 5/1975 | United Kingdom . |

OTHER PUBLICATIONS

"Saginaw Unit-Prior Art".

*Primary Examiner*—Sherman Basinger
*Assistant Examiner*—Stephen P. Avila
*Attorney, Agent, or Firm*—Michael, Best & Friedrich

[57] ABSTRACT

A marine installation comprising a valve and cylinder apparatus including a housing having therein a spool bore extending along an axis, a second bore extending along a second axis parallel to and spaced from the spool bore axis, and a cylinder bore extending along an axis parallel to the spool bore axis, a spool slidably housed within the spool bore, a tubular member slidably housed within the second bore, and a link for moving the spool along the spool bore axis in response to movement of the tubular member along the second axis, a piston slidably housed within the cylinder bore, a piston rod having a first end fixedly connected to the piston, and a second end connected to the propulsion unit for causing pivotal movement of the propulsion unit about its steering axis in response to axial movement of the piston rod, and a cable assembly including a sheath fixedly connected to the tubular member for movement therewith, and an inner core extending through the tubular member and fixedly connected to the second end of the piston rod for movement therewith.

29 Claims, 5 Drawing Sheets

POWER STEERING MECHANISM FOR MARINE INSTALLATIONS

RELATED APPLICATIONS AND PATENTS

Attention is directed to Ferguson U.S. Pat. Appl. Ser. No. 028,958, filed Mar. 23, 1987 and assigned to the assignee hereof.

Attention is also directed to Ferguson U.S. Pat. No. 4,710,141, issued Dec. 1, 1987.

BACKGROUND OF THE INVENTION

The invention relates to power steering mechanisms for marine installations, and, more particularly, to such power steering mechanisms including an integral valve and cylinder assembly.

U.S. Pat. No. 4,595,370 discloses such a power steering mechanism. A disadvantage of this mechanism is that the passageways extending between the spool bore and the cylinder bore are relatively complex. More particularly, referring to FIG. 2 of U.S. Pat. No. 4,595,370, the passageway 50 communicates with the left port of the spool bore and with the right end of the cylinder, and the passageway 48 communicates with the right port of the spool bore and with the left end of the cylinder. As a result, an external fluid line 52 is necessary.

SUMMARY OF THE INVENTION

The invention provides a marine installation comprising a propulsion unit adapted to be mounted on a boat for pivotal movement relative thereto about a generally vertical steering axis, the propulsion unit including a rotatably mounted propeller, an engine drivingly connected to the propeller, a valve and cylinder apparatus including a housing having therein a first bore extending along an axis and adapted to communicate with a source of fluid under pressure, a cylinder bore having opposite first and second ends and extending along an axis parallel to the first bore axis, first and second ports communicating with the first bore, a first passageway including a first end communicating with the first port, and a second end communicating with the first end of the cylinder bore, and a second passageway including a first end communicating with the second port, and a second end communicating with the second end of the cylinder bore, a first member slidably housed within the first bore, the first member being movable between a first position wherein the first and second ports are equally pressurized by the source, a second position wherein the first port communicates with the source, and a third position wherein the second port communicates with the source, a second member movable along a second axis parallel to the first bore axis, and means for moving the first member along the first bore axis in response to movement of the second member along the second axis, a piston slidably housed within the cylinder bore, a piston rod having a first end fixedly connected to the piston, and a second end connected to the propulsion unit for causing pivotal movement of the propulsion unit about the steering axis in response to axial movement of the piston rod, a cable assembly including a sheath fixedly connected to the second member for movement therewith, and an inner core fixedly connected to the second end of the piston rod for movement therewith, and operator actuatable means for causing relative movement of the sheath and the core.

The invention also provides a valve apparatus comprising a housing having therein a spool bore extending along an axis, a valve spool slidably housed within the spool bore, a member supported by the housing for movement along a second axis parallel to the spool bore axis, and means for moving the spool along the spool bore axis in response to movement of the member along the second axis.

The invention also provides a marine installation comprising a propulsion unit adapted to be mounted on a boat for pivotal movement relative thereto about a generally vertical steering axis, the propulsion unit including a rotatably mounted propeller, an engine drivingly connected to the propeller, a valve and cylinder apparatus including a housing having therein a first bore extending along an axis, a first member slidably housed within the first bore, a second member supported by the housing for movement along a second axis parallel to the first bore axis, and means fixedly connecting the first member to the second member for moving the first member along the first bore axis in the same direction as the second member in response to movement of the second member along the second axis, the means connecting the first member to the second member including a link which is rotatable relative to the first member and to the second member, which is fixed to the second member against movement axially of the second member, and which is fixed to the first member against movement axially of the first member, a piston rod having an end connected to the propulsion unit for causing pivotal movement of the propulsion unit about the steering axis in response to axial movement of the piston rod, means for moving the piston rod axially in response to movement of the first member along the first bore axis, a cable assembly including a sheath fixedly connected to the second member for movement therewith, and an inner core fixedly connected to the second end of the piston rod for movement therewith, and operator actuatable means for causing relative movement of the sheath and the core.

The invention also provides a marine installation comprising a propulsion unit adapted to be mounted on a boat for pivotal movement relative thereto about a generally vertical steering axis, the propulsion unit including a rotatably mounted propeller, an engine drivingly connected to the propeller, a valve and cylinder apparatus including a housing having therein a first bore extending along an axis, and a second bore extending along a second axis parallel to the first axis, a first member slidably housed within the first bore, a second member slidably housed within the second bore for movement along the second axis, means for moving the first member along the first bore axis in response to movement of the second member along the second axis, and means utilizing fluid from the first bore for lubricating the second member within the second bore, a piston rod having an end connected to the propulsion unit for causing pivotal movement of the propulsion unit about the steering axis in response to axial movement of the piston rod, means for moving the piston rod axially in response to movement of the first member along the first bore axis, a cable assembly including a sheath fixedly connected to the second member for movement therewith, and an inner core fixedly connected to the end of the piston rod for movement therewith, and operator actuatable means for causing relative movement of the sheath and the core.

A principal feature of the invention is the provision of a marine installation comprising a valve and cylinder apparatus including a housing having therein a spool bore extending along an axis, a spool slidably housed within the spool bore, an input member movable along a second axis parallel to the spool bore axis, and means for moving the spool along the spool bore axis in response to movement of the input member along the second axis.

Another principal feature of the invention is the provision of a marine installation as described above wherein the spool moves along the spool bore axis in the direction opposite the direction of movement of the member. This arrangement permits the spool and the passageways between the spool bore and the cylinder bore to have a relatively simple construction. The spool can have a simple three-land and two-groove construction, and movement of the spool in the opposite direction of the input member allows the right spool bore port to communicate with the right end of the cylinder and the left spool bore port to communicate with the left end of the cylinder. Therefore, it is not necessary for the passageways communicating between the spool bore and the cylinder bore to overlap.

Another principal feature of the invention is the provision of a marine installation comprising a valve and cylinder apparatus including a housing having therein a spool bore extending along an axis, first, second, third, fourth and fifth ports serially spaced along the spool bore in a given direction and communicating with the spool bore, the third port being adapted to communicate with a source of fluid under pressure, and the first and fifth ports being adapted to return fluid to the source, and a spool slidably housed within the spool bore and having therein first, second and third grooves serially spaced in the direction of the spool bore axis. This arrangement also permits the passageways between the spool bore and the cylinder bore to have a relatively simple construction and permits the spool to move in the same direction as the input member. The three-groove construction of the spool allows the right spool bore port to communicate with the right end of the cylinder and the left spool bore port to communicate with the left end of the cylinder.

Another principal feature of the invention is the provision of a marine installation comprising valve and cylinder apparatus including a housing having therein a spool bore extending along an axis and having a first end, and a second end spaced from the first end in a given direction, a cylinder bore extending along an axis parallel to the spool bore axis and having a first end, and a second end spaced from the first end of the cylinder bore in the given direction, first and second ports communicating with the spool bore, with the second port being spaced from the first port in the given direction, a first passageway communicating between the first port and the first end of the cylinder bore, and a second passageway communicating between the second port and the second end of the cylinder bore. This arrangement allows minimization of the volume of the housing.

Another principal feature of the invention is the provision of a marine installation comprising means utilizing the fluid from the spool bore for lubricating the member within the second bore. Preferably, the lubricating means includes, in the housing, a passageway communicating between the spool bore and the second bore. This arrangement eliminates the need for an additional source of lubrication for the tubular member.

Another principal feature of the invention is the provision of a marine installation wherein the member is movable relative to a reference position wherein the spool is in its center position, and wherein the installation comprises means for biasing the member to the reference position.

Other features and advantages of the invention will become apparent to those skilled in the art upon review of the following detailed description, claims and drawings.

DESCRIPTION OF THE DRAWINGS

FIG. 18 is an enlarged view of a portion of FIG. 11.

Figure 1:
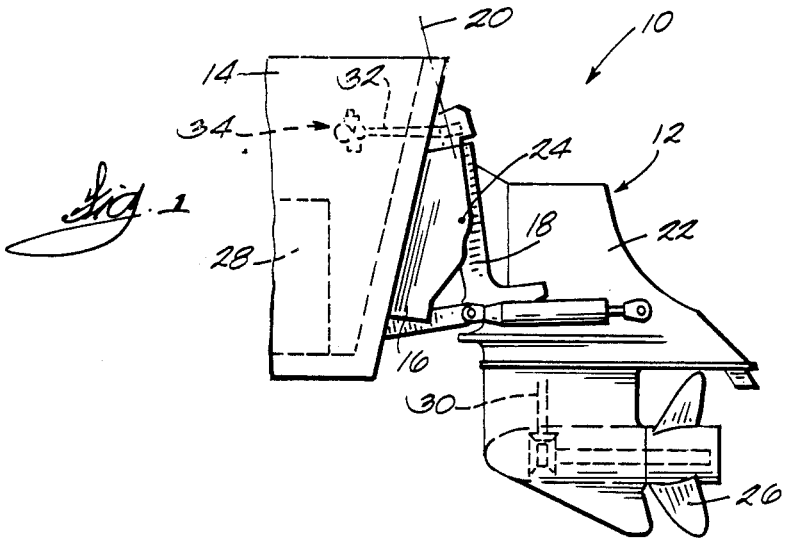
FIG. 1 is a fragmentary side elevational view of a marine installation embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine installation 10 embodying the invention is illustrated in the drawings. As shown in FIG. 1, the marine installation 10 comprises a marine propulsion device 12 mounted on a boat 14. While the illustrated marine propulsion device 12 is a stern drive unit, it should be understood that the marine propulsion device 12 could be an outboard motor.

The marine propulsion device 12 comprises a transom bracket 16 fixedly mounted on the boat 14, and a gimbal ring 18 mounted on the transom bracket 16 for pivotal movement relative thereto about a generally vertical steering axis 20. The marine propulsion device 12 also comprises a propulsion unit 22 which is mounted on the gimbal ring 18 for pivotal movement relative thereto about a generally horizontal tilt axis 24 and which includes a rotatably mounted propeller 26. The marine propulsion device 12 further comprises an engine 28 drivingly connected to the propeller 26 by a conventional drive train 30 (shown in part), and a steering arm 32 fixedly connected to the gimbal ring 18 for causing pivotal movement of the gimbal ring 18 and of the propulsion unit 22 in response to pivotal movement of the steering arm 32. As thus far described, the marine installation 10 is conventional.

Figure 5:
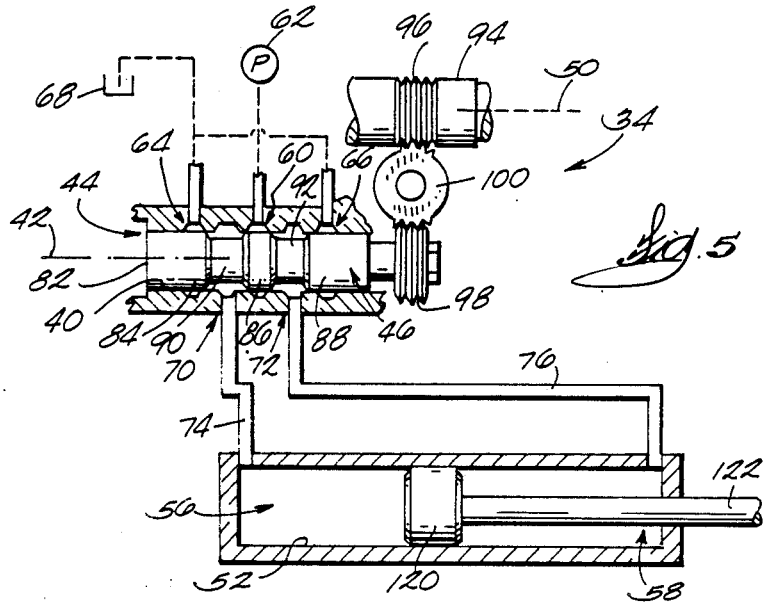
FIG. 5 is a schematic view of the hydraulic circuit of the power steering mechanism shown in FIG. 2.
Figure 2:
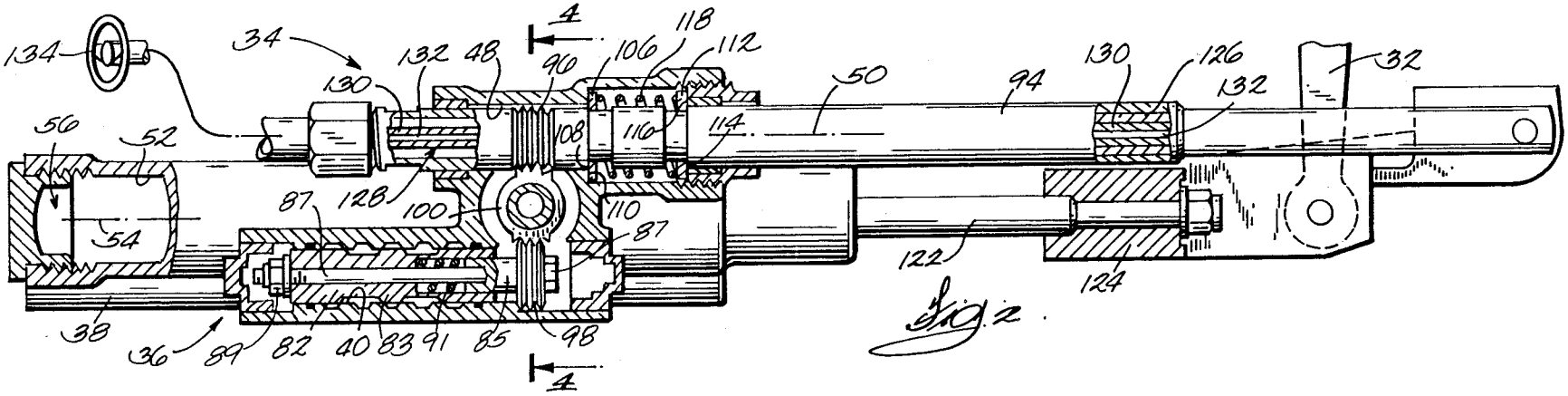
FIG. 2 is a top view, partially in section, of the power steering mechanism of the marine installation shown in FIG. 1.
Figure 3:
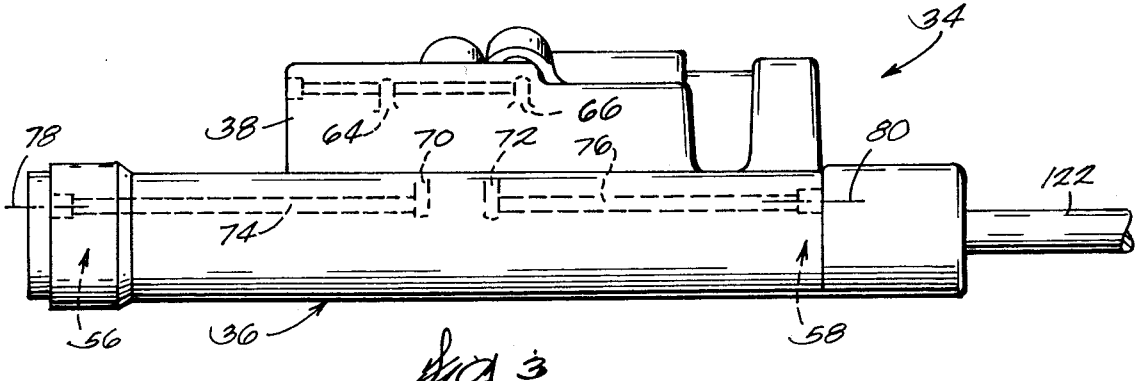
FIG. 3 is a partial elevational view of the power steering mechanism shown in FIG. 2.

The marine installation 10 also comprises a power steering mechanism 34 mounted on the boat 14 and connected to the steering arm 32 for causing pivotal movement of the steering arm 32 in response to operator actuation of the power steering mechanism 34. As best shown in FIG. 2, the power steering mechanism 34 includes a valve and cylinder apparatus 36 including a housing 38 fixedly mounted on the boat 14. The housing 38 has therein a spool bore 40 extending along an axis 42 and having a first or left end 44, and a second or right end 46 spaced from the left end 44 in a given direction (to the right in FIGS. 2 and 5). The housing 38 also has therein a second bore 48 extending along an axis 50 parallel to and spaced from the spool bore axis 42, and a cylinder bore 52 extending along an axis 54 parallel to the spool bore axis 42 and having a first or left end 56, and a second or right end 58. The housing 38 also has therein a first port 60 communicating with the spool bore 40 and with a pump 62 via a passageway 63, and second and third ports 64 and 66, respectively, communicating with the spool bore 40 and with a sump 68 via a passageway 69. The housing 38 further has therein a fourth or left port 70 communicating with the spool bore 40, a fifth or right port 72 communicating with the spool bore 40, a first passageway 74 communicating between the left port 70 and the left end 56 of the cylinder bore 52, and a second passageway 76 communicating between the right port 72 and the right end 58 of the cylinder bore 52. In the preferred embodiment, the second passageway 76 is spaced to the right of the first passageway 74, and the first and second passageways 74 and 76 extend along axes 78 and 80 (see FIG. 3) that are parallel to and coplanar with the spool bore axis 42 and the cylinder bore axis 54. Preferably, the passageway axes 78 and 80 are colinear.

The valve and cylinder apparatus 36 also includes a spool 82 slidably housed within the spool bore 40. The spool 82 includes telescoping left and right spool portions 83 and 85, respectively. A bolt 87 extends through the spool portions 83 and 85, and a nut 89 is threaded onto the left end of the bolt 87. A spring 91 biases the right spool portion 85 against the head of the bolt 87 and biases the left spool portion 83 against the nut 89. The left spool portion 83 has thereon first, second and third lands 84, 86 and 88, respectively, which are serially spaced from left to right and which define therebetween first and second or left and right grooves 90 and 92, respectively.

The spool 82 is movable between a center position (shown in FIG. 5), a first or left position (not shown) and a second or right position (not shown). When the spool 82 is in the center position, the fourth and fifth ports 70 and 72 are equally pressurized by fluid entering the spool bore 40 through the first port 60. In the preferred embodiment, the width of the second land 86 is such that both of the fourth and fifth ports 70 and 72 are in communication with the first port 60 when the spool 82 is in the center position. In alternative embodiments, the construction of the spool 82 can be such that both of the fourth and fifth ports 70 and 72 are blocked from the first port 60 when the spool 82 is in the center position. When the spool 82 is in the left position, the first port 60 communicates with the fifth port 72 and the second port 64 communicates with the fourth port 70. When the spool 82 is in the right position, the first port 60 communicates with the fourth port 70 and the third port 66 communicates with the fifth port 72. Thus, when the spool 82 is in the left position, fluid is supplied to the right end 58 of the cylinder bore 52 via the right port 72 and the second passageway 76. When the spool 82 is in the right position, fluid is supplied to the left end 56 of the cylinder bore 52 via the left port 70 and the first passageway 74.

Figure 4:
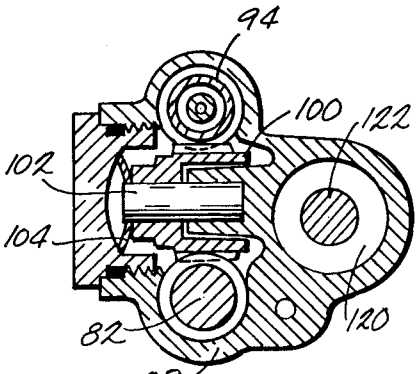
FIG. 4 is a cross sectional view taken along line 4—4 in FIG. 2.

The valve and cylinder apparatus 36 also includes a steering tube or member 94 slidably housed within the second bore 48 for movement along the axis 50, and means for moving the spool 82 along the spool bore axis 42 in response to movement of the steering tube 94 along the axis 50. While various suitable moving means can be employed, in the preferred embodiment, this means moves the spool 82 in the direction opposite the direction of movement of the steering tube 94. Furthermore, in the preferred embodiment, this means includes a plurality of axially spaced teeth 96 on the steering tube 94, a plurality of axially spaced teeth 98 on the right spool portion 85, and a gear 100 having teeth in meshing engagement with the teeth 96 on the steering tube 94 and with the teeth 98 on the spool 82. As shown in FIG. 4, the gear 100 is pivotally supported on a pin 102 within the housing 38 and is biased into engagement with the steering tube 94 and with the spool 82 by a spring washer 104. As shown in FIG. 2, movement of the steering tube 94 to the right causes clockwise rotation of the gear 100, and this in turn causes movement of the spool 82 to the left. Movement of the steering tube 94 to the left causes counterclockwise rotation of the gear 100, and this in turn causes movement of the spool 82 to the right.

The steering tube 94 is movable between center, first and second positions respectively corresponding to the center, first and second positions of the spool 82. In order to bias the spool 82 to the center or reference position, the apparatus 36 includes means for biasing the steering tube 94 to its center position. While various suitable biasing means can be used, in the illustrated construction, this means includes a left washer 106 engageable with a shoulder 108 on the steering tube 94 and with a shoulder 110 in the housing 38, a right washer 112 engageable with a shoulder 114 on the steering tube 94 and with a shoulder 116 in the housing 38, and a spring 118 extending between the washers 106 and 112. The spring 118 biases the washers 106 and 112 against their respective housing shoulders 110 and 116, and the steering tube 94 is centered by engagement of the steering tube shoulders 108 and 114 with their respective washers 106 and 112. When the steering tube 94 moves to the left, the right washer 112 moves with the steering tube 94 and compresses the spring 118. When the steering tube 94 moves to the right, the left washer 106 moves with the steering tube 94 and compresses the spring 118. In either case, the spring 118 opposes the force moving the steering tube 94, and the spring 118 returns the steering tube 94 to its center position when the force is removed or becomes less than the force of the spring 118.

The power steering mechanism 34 also includes a piston 120 slidably housed within the cylinder bore 52, and a piston rod 122 having a first or left end fixedly connected to the piston 120 for movement therewith, and a second or right end pivotally connected to the steering arm 32 via a bracket 124 for causing pivotal movement of the steering arm 32 in response to axial movement of the piston rod 122. The power steering mechanism 34 further includes a support tube 126 that is slidably housed within the steering tube 94 and that is connected to the bracket 124, and a cable assembly 128 including a sheath 130 which is fixedly connected to the steering tube 94 for movement therewith, and an inner core 132 which extends through and is fixedly connected to the support tube 126. Thus, the core 132 is connected to the steering arm 32 and to the right end of the piston rod 122.

The marine installation 10 further comprises operator actuatable means for causing relative movement of the sheath 130 and the core 132. While various suitable means can be employed, in the preferred embodiment, such means includes a conventional steering mechanism or helm 134 (shown schematically in FIG. 2). When the steering mechanism 134 is operated so as to move the core 132 to the right relative to the sheath 130, the steering arm 32 resists such movement of the core 132 and causes movement of the sheath 130 to the left relative to the core 132. This moves the steering tube 94 to the left, thereby moving the spool 82 to the right. As explained above, this supplies fluid to the left end 56 of the cylinder bore 52. This in turn moves the piston 120 and piston rod 122 to the right, thereby moving the steering arm 32 to the right. Similarly, operation of the steering mechanism 134 so as to move the core 132 to the left moves the steering arm 32 to the left, thereby moving the spool 82 to the left.

When the spool 82 is in the center position, the spool 82, and more particularly the left spool portion 83, is positioned in the spool bore 40 such that the product of the pressure in the left end 56 of the cylinder bore 52 times the area of the piston 120 exposed to the left end 56 of the cylinder bore 52 is equal to the product of the pressure in the right end 58 of the cylinder bore 52 times the area of the piston 120 exposed to the right end 58 of the cylinder bore 52. The center position can be adjusted, i.e., the spool 82 can be properly centered, by rotating the nut 89 on the bolt 87 to move the left spool portion 83 relative to the right spool portion 85 until the left spool portion 83 is in the position wherein the forces on the opposite sides of the piston 120 are balanced. Operator input via the steering mechanism 134 disturbs this balance and initiates power assist.

When the spool 82 is in the left position, the pressure differential across the piston 120 is maximized so as to bias the piston 120 to the left. Partial displacement of the spool 82 to the left results in a lesser bias on the piston 120 toward the left.

During operation, a steering torque can be exerted on the steering arm 32 by the propulsion unit 22. This steering torque on the steering arm 32 causes relative movement of the sheath 130 and core 132 which in turn moves the spool 82 so that pressure is developed on the piston 122 to oppose the steering torque induced by the propulsion unit 22. Thus, the operator is isolated from steering torques induced by the propulsion unit 22.

Figure 6:
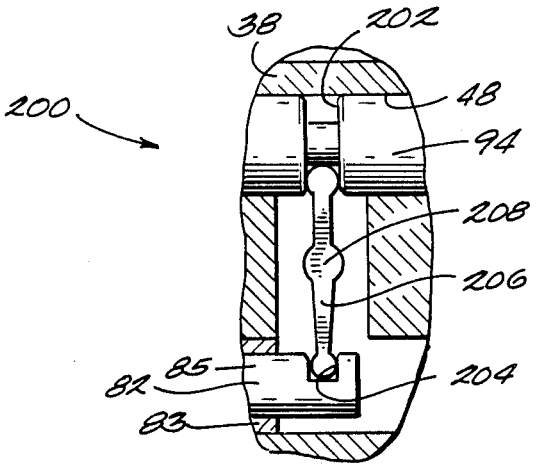
FIG. 6 is a partial view of a power steering mechanism which is an alternative embodiment of the invention.

A power steering mechanism 200 which is an alternative embodiment of the invention is illustrated in FIG. 6. Except as described below, the mechanism 200 is substantially identical to the power steering mechanism 34 of the preferred embodiment, and common elements have been given the same reference numerals. In the alternative embodiment, the means for moving the spool 82 in the direction opposite the direction of movement of the steering tube 94 includes an annular groove or recess 202 in the steering tube 94, a recess 204 in the right end of the right spool portion 85, and a lever 206 mounted for pivotal movement about an axis 208 and having an upper end pivotally housed in the groove 202 and a lower end pivotally housed in the recess 204. Movement of the steering tube 94 to the right causes clockwise rotation of the lever 206, and this in turn causes movement of the right spool portion 85 to the left. Movement of the steering tube 94 to the left causes counterclockwise rotation of the lever 206, and this in turn causes movement of the right spool portion 85 to the right.

A power steering mechanism 300 which is a second alternative embodiment of the invention is illustrated in FIGS. 9–18. The power steering mechanism 300 includes a valve and cylinder apparatus 310 including a housing 312 fixedly mounted on a boat (not shown). The housing 312 has therein a spool bore 314 (FIG. 11) extending along an axis 316 and having a first or right end 318, and a second or left end 320, a cylinder bore 322 (FIGS. 11 and 13) extending along an axis 324 parallel to the spool bore axis 316 and having a first or right end 326, and a second or left end 328, and a second bore 330 (FIG. 12) extending along an axis 332 parallel to the spool bore axis 316 and having a first or right end 334, and a second or left end 336. The housing 312 also has therein (see FIG. 11) first, second, third, fourth and fifth ports 338, 340, 342, 344 and 346, respectively, which are serially spaced from left to right and which communicate with the spool bore 314. The third port 342 communicates with a pump 348 via a passageway 349, and the first and fifth ports 338 and 346 communicate with a sump 350 via a passageway 351. The housing 312 also has therein (see FIGS. 13, 15 and 16) a first passageway 352 including a first end communicating with the second port 340, and a second end communicating with the left end 328 of the cylinder bore 322, and a second passageway 354 including a first end communicating with the fourth port 344, and a second end communicating with the right end 326 of the cylinder bore 322. The first and second passageways 352 and 354 extend along axes 356 and 358, respectively. Preferably, the axes 356 and 358 are colinear and parallel with the spool bore axis 316.

The valve and cylinder apparatus 310 also includes a spool 360 slidably housed within the spool bore 314 and including (see FIG. 11) first, second, third and fourth lands 362, 364, 366 and 368, respectively, which define therebetween first, second and third grooves 370, 372 and 374, respectively. The grooves 370, 372 and 374 are serially spaced from left to right. The spool 360 is movable between a center position (shown in FIG. 11), a first or left position (not shown) and a second or right position (not shown). The spool 360, ports 338–346 and passageways 352 and 354 function in the same manner as the spool 252, ports 230–238 and passageways 244 and 246 of the first alternative embodiment. Thus, when the spool 360 is in the left position, fluid is supplied to the left end 328 of the cylinder bore 322 via the second port 340 and the first passageway 352. When the spool 360 is in the right position, fluid is supplied to the right end 326 of the cylinder bore 322 via the fourth port 344 and the second passageway 354.

The valve and cylinder apparatus 310 also includes a steering tube, cable guide tube or cable guide member 376 slidably housed within the second bore 330 for movement along the axis 332. In the illustrated construction, the cable guide tube 376 is partially supported within the second bore 330 by an annular bushing or retaining member 450 housed within the second bore 330. The bushing 450 engages a shoulder 452 in the housing 312 and is secured against the shoulder 452 by a retaining ring 454. An O-ring 456 seals the joint between the bushing 450 and the housing 312, and an annular seal 458 seals the joint between the bushing 450 and the cable guide tube 376. An annular bellows 460 surrounds the cable guide tube and extends from the left end of the bore 330. A second annular bellows 462 surrounds the cable guide tube 376 and extends from the right end of the bore 330.

The apparatus 310 also includes means for moving the spool 360 along the spool bore axis 316 in response to movement of the steering tube 376 along the axis 332. In the illustrated construction, this means moves the spool 360 in the same direction as the steering tube 376 and includes means for fixedly connecting the spool 360 to the steering tube 376. While various suitable connecting means can be employed, in the illustrated construction, this means includes a link 378 which is rotatable relative to the steering tube 376 and to the spool 360, which is fixed to the steering tube 376 against movement axially of the steering tube 376, and which is fixed to the spool 360 against movement axially of the spool 360.

In the illustrated construction, the steering tube 376 has therein a circumferentially extending recess 380 (FIG. 12), the link 378 includes an annular, tapered inner surface 382 defining a bore 383, and the means for connecting the spool 360 to the tube 376 further includes a pair of semi-circular bushings 384 seated in the recess 380 and having tapered outer surfaces 386 complementary with the inner surface 382 of the link 378, and means for securing the bushings 384 in the bore 383 and for forcing the outer surfaces 386 of the bushings 384 against the inner surface 382 of the link 378. In the illustrated construction, the securing means includes a plate 388 removably secured to the link 378 by bolts 390. The plate 388 "wedges" the bushings 384 into the bore 383 and forces the opposite ends of the bushings 384 into engagement so that the bushings 384 assume a minimum inside diameter which is greater than the outside diameter of the tube 376 within the recess 380. Therefore, the tube 376 is rotatable inside the bushings 384, but engagement of the walls of the recess 380 with the bushings 384 prevents axial movement of the member 376 relative to the link 378.

The link 378 has therein a second bore 392 (FIGS. 17 and 18), and the left end of the spool 360 is externally threaded and extends through the bore 392 in the link 378 so that the spool 360 is rotatable relative to the link 378. Movement of the link 378 axially of the spool 360 is prevented by a pair of washers 394 and 396. The washer 394 engages a spring 398 which in turn engages a shoulder 400 (FIG. 11) on the spool 360 to yieldably prevent movement of the link 378 to the right relative to the spool 360, and the washer 396 engages a nut 402 threaded onto the spool 360 to prevent movement of the link 378 to the left relative to the spool 360. The axial position of the link 378 relative to the spool 360 can be adjusted by turning the nut 402. A cap 470 snaps over the left washer 396 and protects the nut 402, and a bellows 472 extends between the link 378 and the housing 312 and protects the spring 398.

The link 378 is connected to the steering tube 376 and the spool 360 as follows. First, the link 378 is placed over the left end of the steering tube 376 so that the steering tube extends through the bore 383 and so that the link 378 is located to the right of the recess 380. Next, the bushings 384 are located in the recess 380, and the link is moved to the left so that the inner surface 382 of the link surrounds the outer surfaces 386 of the bushings 384. Next, the plate 388 is bolted to the link 378. As described above, this fixes the link 378 against movement axially of the tube 376. At the same time the link 378 is placed over the left end of the tube 376, the link 378 is placed over the left end of the spool 360 so that left end of the spool 360 extends through the bore 392 in the link 378. The link 378 is secured to the spool 360 by threading the nut 402 onto the left end of the spool 360, with the washer 396 captured between the nut 402 and the link 378.

The tube 376 is movable between center, first and second positions respectively corresponding to the center, first and second positions of the spool 360. In order to bias the spool 360 to the center or reference position, the apparatus 310 includes means for biasing the tube 376 to its center position. While various suitable biasing means can be used, in the illustrated construction, this means includes (see FIG. 12) a left washer 404 engageable with a retaining ring 406 on the tube 376 and with a shoulder 408 in the housing 312, a right washer 410 engageable with a retaining ring 412 on the tube 376 and with a shoulder 414 in the housing 312, and a spring 416 extending between the washers 404 and 410. In the illustrated construction, the shoulder 408 is formed by the bushing 450. The spring 416 biases the washers 404 and 410 against their respective housing shoulders 408 and 414 and the tube 376 is centered by engagement of the retaining rings 406 and 412 with their respective washers 404 and 410. When the tube 376 moves to the left, the right washer 410 moves with the tube 376 and compresses the spring 416. When the tube 376 moves to the right, the left washer 404 moves with the tube 376 and compresses the spring 416.

Figure 14:
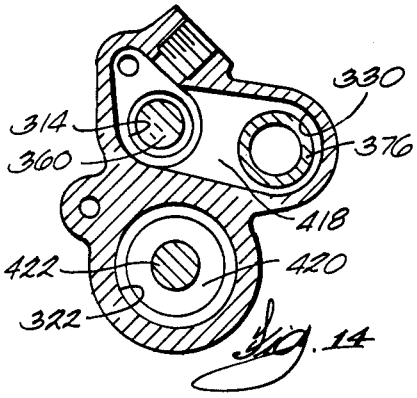
FIG. 14 is a cross-sectional view taken along line 14—14 in FIG. 9.
Figure 15:
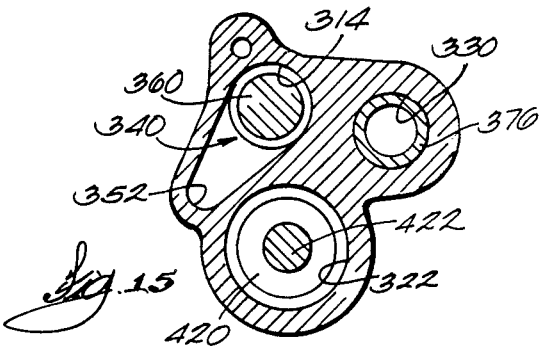
FIG. 15 is a cross-sectional view taken along line 15—15 in FIGS. 9 and 13.
Figure 16:
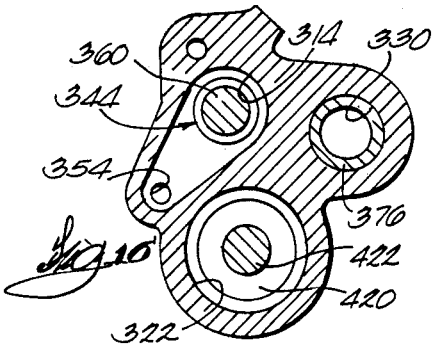
FIG. 16 is a cross-sectional view taken along line 16—16 in FIGS. 9 and 13.
Figure 17:
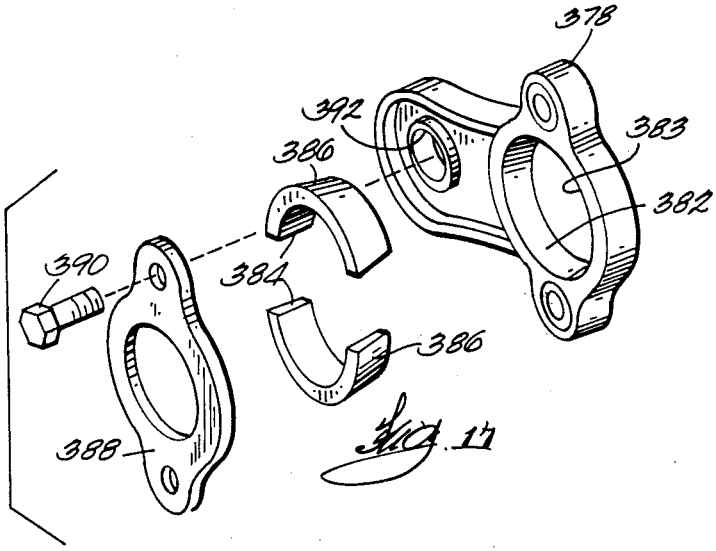
FIG. 17 is an exploded view of the link for connecting the cable guide tube to the spool.
Figures 9, 10, 11, 16:
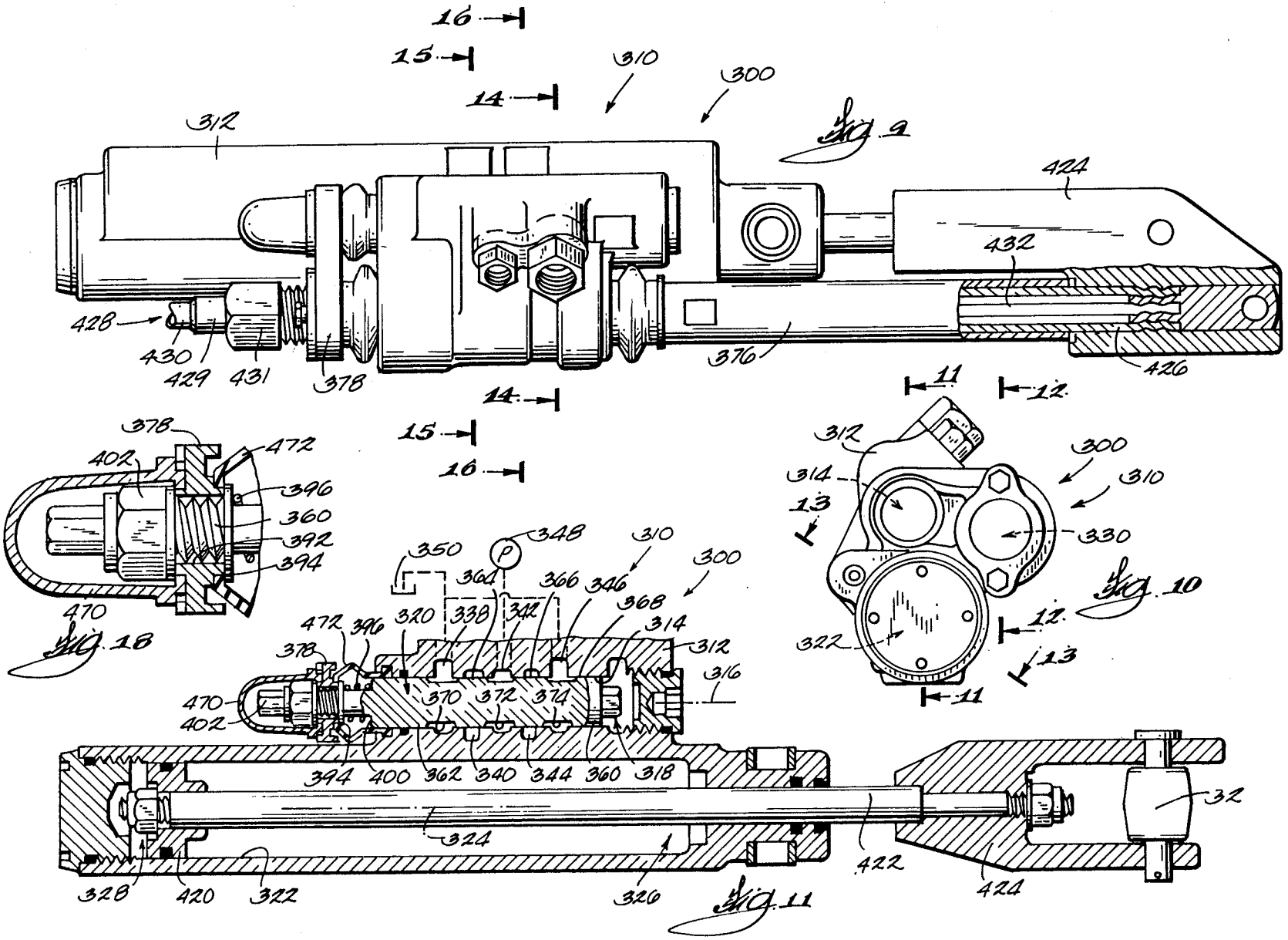
FIG. 9 is a top view of a power steering mechanism which is a second alternative embodiment of the invention.
FIG. 10 is a left end elevational view of the power steering mechanism shown in FIG. 9.
FIG. 11 is a cross-sectional view taken along line 11—11 in FIG. 10.

The valve and cylinder apparatus 310 also includes means utilizing hydraulic fluid or oil from the spool bore 314 for lubricating the steering tube 376 within the second bore 330. While various suitable means can be used, in the illustrated construction, such means includes, in the housing 312, a third passageway 418 communicating between the spool bore 314 and the second bore 330. This is shown in FIG. 14.

The power steering mechanism 300 also includes a piston 420 slidably housed within the cylinder bore 322, and a piston rod 422 having a first or left end fixedly connected to the piston 420 for movement therewith, and a second or right end pivotally connected to the steering arm 32 via a bracket 424 for causing pivotal movement of the steering arm 32 in response to axial movement of the piston rod 422. The power steering mechanism 300 further includes a support tube 426 (FIG. 9) that is slidably housed within the cable guide tube 376 and that is connected to the bracket 424, and a cable assembly 428 including a sheath 430 which is fixedly connected to the tube 376 for movement therewith. In the illustrated construction, the sheath 430 has crimped thereon on an annular end fitting 429 that is connected to the tube 376 by a collar 431 threaded onto the left end of the tube 376. Because the tube 376 is rotatable relative to the link 378, rotation of the tube 376 while the collar 431 is being threaded onto the tube 376 will not rotate the link 378 and exert stress on the spool 360. The cable assembly also includes a guide tube 433 that extends from the end fitting 429 and through the tube 376, and an inner core 432 which extends through the guide tube 433 and the support tube 426 and is fixedly connected to the bracket 424. Thus, the core 432 is connected to the steering arm 32 and to the right end of the piston rod 422.

When the cable core 432 is moved to the right relative to the sheath 430, the steering arm 32 resists such movement and causes movement of the sheath 430 to the left relative to the cable core 432. This moves the cable guide tube 376 and spool 360 to the left position and thereby, as explained above, causes fluid flow to the left end 328 of the cylinder bore 322. This in turn causes the piston 420 and piston rod 422 to move to the right, thereby causing the steering arm 32 to move to the right. Similarly, movement of the core 432 to the left moves the steering arm 32 to the left.

Figure 7:
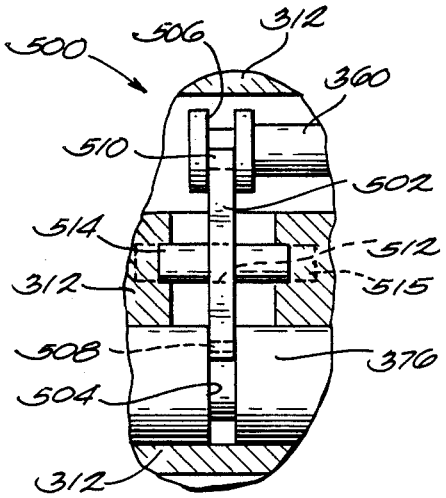
FIG. 7 is a partial view of a power steering mechanism which is a third alternative embodiment of the invention.
Figure 8:
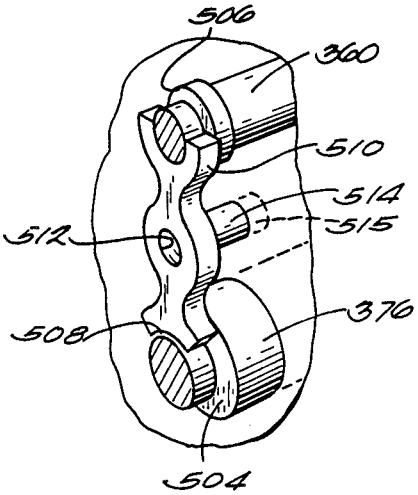
FIG. 8 is a fragmentary perspective view of the mechanism shown in FIG. 7.
Figure 12:
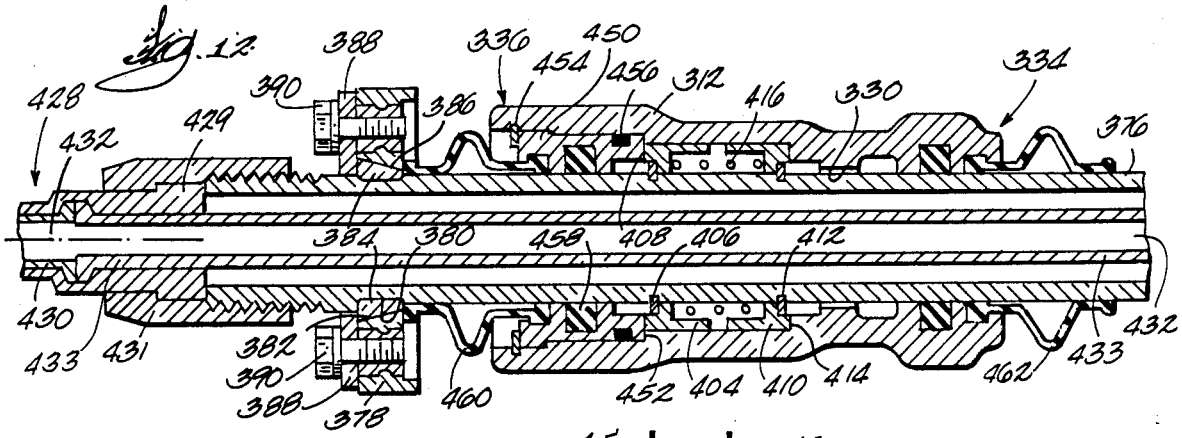
FIG. 12 is a cross-sectional view taken along line 12—12 in FIG. 10.
Figure 13:
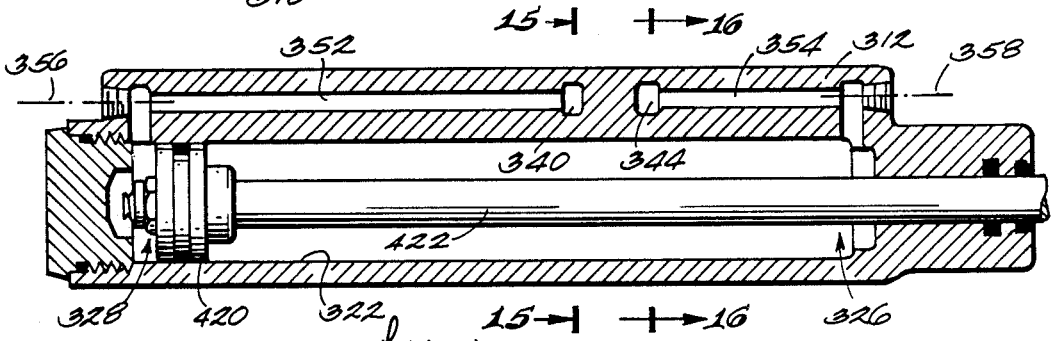
FIG. 13 is a cross-sectional view taken along line 13—13 in FIG. 10.

A power steering mechanism 500 which is a third alternative embodiment of the invention is illustrated in FIGS. 7 and 8. Except as explained below, the power steering mechanism 500 is substantially identical to the power steering mechanism 300, and common elements have been given the same reference numerals. In the power steering mechanism 500, the means for fixedly connecting the spool 360 to the steering tube 376 includes a link 502 which is fixed to the steering tube 376 against movement axially of the steering tube 376, which is fixed to the spool 360 against movement axially of the spool 360, which is rotatable relative to the steering tube 376 and to the spool 360, and which is located interiorly of the housing 312.

As shown in FIG. 7, the steering tube 376 has therein a circumferentially extending groove or recess 504, the spool 360 has therein an annular groove or recess 506, the lower end of the link 502 has thereon an arcuate portion 508 received in the groove 504, and the upper end of the link 502 has thereon an arcuate portion 510 received in the groove 506. The center portion of the link 502 has therethrough a bore 512 which slidably houses a pin 514 having opposite ends supported by the housing 312. The link 502 slides along the pin 514 in response to axial movement of the steering tube 376. The pin 514 maintains the link 502 in perpendicular relation to the spool 360 and to the steering tube 376 and thus prevents jamming of the link 502. Alternatively, link 502 may be fixedly attached to pin 514 and pin 514 slidably supported by a bore 515 extended axially beyond the length of pin 514 in housing 312 such that bore 515 maintains the link 502 in perpendicular relation to the spool 360 and to the steering tube 376 and thus prevents jamming of the link 502.

Various features of the invention are set forth in the following claims.

We claim:

1. A marine installation comprising a propulsion unit adapted to be mounted on a boat for pivotal movement relative thereto about a generally vertical steering axis, said propulsion unit including a rotatably mounted propeller, an engine drivingly connected to said propeller, a valve and cylinder apparatus including a housing having therein a first bore extending along an axis and adapted to communicate with a source of fluid under pressure, a cylinder bore having opposite first and second ends and extending along an axis parallel to said first bore axis, first and second ports communicating with said first bore, a first passageway including a first end communicating with said first port, and a second end communicating with said first end of said cylinder bore, and a second passageway including a first end communicating with said second port, and a second end communicating with said second end of said cylinder bore, a first member slidably housed within said first bore, said first member being movable between a first position wherein said first and second ports are equally pressurized by the source, a second position wherein said first port communicates with the source, and a third position wherein said second port communicates with the source, a second member supported by said housing for movement along a second axis parallel to said first bore axis, and means for moving said first member along said first bore axis in response to movement of said second member along said second axis, a piston slidably housed within said cylinder bore, a piston rod having a first end fixedly connected to said piston, and a second end connected to said propulsion unit for causing pivotal movement of said propulsion unit about said steering axis in response to axial movement of said piston rod, a cable assembly including a sheath fixedly connected to said second member for movement therewith, and an inner core fixedly connected to said second end of said piston rod for movement therewith, and operator actuatable means for causing relative movement of said sheath and said core.

2. A marine installation as set forth in claim 1 wherein said housing also has therein a second bore extending along said second axis, wherein said second member is tubular and is slidably housed within said second bore, and wherein said inner core extends through said second member.

3. A marine installation as set forth in claim 1 wherein said moving means moves said first member in the same direction as said second member.

4. A marine installation as set forth in claim 3 wherein said moving means includes means for fixedly connecting said first member to said second member.

5. A marine installation as set forth in claim 4 wherein said means for connecting said first member to said second member includes a link which is rotatable relative to said second member, which is fixed to said second member against movement axially of said second member, and which is fixed to said first member against movement axially of said first member.

6. A marine installation as set forth in claim 5 wherein said second member has therein a circumferentially extending recess, wherein said link has therethrough a bore, and wherein said means for connecting said first member to said second member further includes a pair of semi-circular bushings seated in said recess, and means for securing said bushings in said bore.

7. A marine installation as set forth in claim 6 wherein said link includes an annular, tapered inner surface defining said bore, wherein said bushings include tapered outer surfaces complementary with said inner surface, and wherein said securing means forces said outer surfaces against said inner surface.

8. A marine installation as set forth in claim 4 wherein said means for connecting said first member to said second member includes a link which is rotatable relative to said first member, which is fixed to said first member against movement axially of said first member, and which is fixed to said second member against movement axially of said second member.

9. A marine installation as set forth in claim 4 wherein said second member has therein a circumferentially extending recess, and wherein said means for connecting said first member to said second member includes a link which has therethrough a bore, and which is fixed to said first member against movement axially of said first member, a pair of semi-circular bushings seated in said recess, and means for securing said bushings in said bore.

10. A marine installation as set forth in claim 9 wherein said link includes an annular, tapered inner surface defining said bore, wherein said bushings include tapered outer surfaces complementary with said inner surface, and wherein said securing means forces said outer surfaces against said inner surface.

11. A marine installation as set forth in claim 4 wherein said means for connecting said first member to said second member includes a link located interiorly of said housing.

12. A marine installation as set forth in claim 1 wherein said moving means moves said first member in the direction opposite the direction of movement of said second member.

13. A marine installation as set forth in claim 12 wherein said means for moving said first member includes gear means.

14. A marine installation as set forth in claim 12 wherein said means for moving said first member includes a plurality of axially spaced teeth on said second member, a plurality of axially spaced teeth on said first member, and a gear having teeth in meshing engagement with said teeth on said second member and with said teeth on said first member.

15. A marine installation as set forth in claim 1 wherein said housing also has therein a second bore extending along said second axis, wherein said second member is slidably housed within said second bore, and wherein said valve and cylinder apparatus further includes means utilizing fluid from said first bore for lubricating said second member within said second bore.

16. A marine installation as set forth in claim 15 wherein said lubricating means includes, in said housing, a third passageway communicating between said first bore and said second bore.

17. A marine installation as set forth in claim 1 wherein said second member is movable relative to a reference position, wherein said first member is in said first position when said second member is in said reference position, and wherein said valve and cylinder apparatus further includes means for biasing said second member to said reference position.

18. A marine installation as set forth in claim 17 wherein said second member is movable in opposite first and second directions within said second bore, and wherein said biasing means includes means for biasing said second member in said first direction in response to movement of said second member in said second direction from said reference position, and for biasing said second member in said second direction in response to movement of said second member in said first direction from said reference position.

19. A marine installation as set forth in claim 1 wherein said first passageway extends along an axis parallel to said first bore axis, and wherein said second passageway extends along an axis colinear with said first passageway axis.

20. A marine installation as set forth in claim 1 wherein said first passageway extends along an axis parallel to and coplanar with said first bore axis and said cylinder bore axis, and wherein said second passageway extends along an axis parallel to and coplanar with said first bore axis and said cylinder bore axis.

21. A marine installation as set forth in claim 20 wherein said passageway axes are colinear.

22. A marine installation as set forth in claim 1 wherein said second port is spaced from said first port in a given direction, wherein said second end of said cylinder bore is spaced from said first end of said cylinder bore in said direction, and wherein said second passageway is spaced from said first passageway in said direction.

23. A marine installation comprising a propulsion unit adapted to be mounted on a boat for pivotal movement relative thereto about a generally vertical steering axis, said propulsion unit including a rotatably mounted propeller, an engine drivingly connected to said propeller, a valve and cylinder apparatus including a housing having therein a first bore extending along an axis, a first member slidably housed within said first bore, a second member supported by said housing for movement along a second axis parallel to said first bore axis, and means fixedly connecting said first member to said second member for moving said first member along said first bore axis in the same direction as said second member in response to movement of said second member along said second axis, said means connecting said first member to said second member including a link which is rotatable relative to said first member and to said second member, which is fixed to said second member against movement axially of said second member, and which is fixed to said first member against movement axially of said first member, a piston rod having an end connected to said propulsion unit for causing pivotal movement of said propulsion unit about said steering axis in response to axial movement of said piston rod, means for moving said piston rod axially in response to movement of said first member along said first bore axis, a cable assembly including a sheath fixedly connected to said second member for movement therewith, and an inner core fixedly connected to said end of said piston rod for movement therewith, and operator actuatable means for causing relative movement of said sheath and said core.

24. A marine installation as set forth in claim 23 wherein said second member has therein a circumferentially extending recess, wherein said link has therethrough a bore, and wherein said means connecting said first member to said second member further includes a pair of semi-circular bushings seated in said recess, and means for securing said bushings in said bore.

25. A marine installation as set forth in claim 24 wherein said link includes an annular, tapered inner surface defining said bore, wherein said bushings include tapered outer surfaces complementary with said inner surface, and wherein said securing means forces said outer surfaces against said inner surface.

26. A marine installation as set forth in claim 23 wherein said link is located interiorly of said housing.

27. A marine installation comprising a propulsion unit adapted to be mounted on a boat for pivotal movement relative thereto about a generally vertical steering axis, said propulsion unit including a rotatably mounted propeller, an engine drivingly connected to said propeller, a valve and cylinder apparatus including a housing having therein a first bore extending along an axis, and a second bore extending along a second axis parallel to said first axis, a first member slidably housed within said first bore, a second member slidably housed within said second bore for movement along said second axis, means for moving said first member along said first bore axis in response to movement of said second member along said second axis, and means utilizing fluid from said first bore for lubricating said second member within said second bore, a piston rod having an end connected to said propulsion unit for causing pivotal movement of said propulsion unit about said steering axis in response to axial movement of said piston rod, means for moving said piston rod axially in response to movement of said first member along said first bore axis, a cable assembly including a sheath fixedly connected to said second member for movement therewith, and an inner core fixedly connected to said end of said piston rod for movement therewith, and operator actuatable means for causing relative movement of said sheath and said core.

28. A marine installation as set forth in claim 27 wherein said lubricating means includes, in said housing, a third passageway communicating between said first bore and said second bore.

29. A marine installation as set forth in claim 27 wherein said first bore is adapted to communicate with a source of fluid under pressure, wherein said means for moving said piston rod includes, in said housing, a cylinder bore having opposite first and second ends and extending along an axis parallel to said first bore axis, first and second ports communicating with said first bore, a first passageway including a first end communicating with said first port, and a second end communicating with said first end of said cylinder bore, and a second passageway including a first end communicating with said second port, and a second end communicating with said second end of said cylinder bore, wherein said first member is movable between a first position wherein said first and second ports are equally pressurized by the source, a second position wherein said first port communicates with the source, and a third position wherein said second port communicates with the source, wherein said means for moving said piston rod also includes a piston slidably housed within said cylinder bore, and wherein said piston rod has a first end fixedly connected to said piston.

* * * * *